US006124556A

United States Patent [19]

Thalhammer

[11] Patent Number: 6,124,556

[45] Date of Patent: Sep. 26, 2000

[54] ELECTRICAL SWITCH, IN PARTICULAR FOR VEHICLES

[75] Inventor: Robert Thalhammer, Iffeldorf, Germany

[73] Assignee: Merit-Malta Ltd., Mriehel, Malta

[21] Appl. No.: 08/919,034

[22] Filed: Aug. 27, 1997

[30] Foreign Application Priority Data

Aug. 28, 1996 [EP] European Pat. Off. ..... 96113712

[51] Int. Cl.[7] ..... H01H 15/00; H01H 3/42

[52] U.S. Cl. ..... 200/16 R; 200/533

[58] Field of Search ..... 200/16 R, 16 C, 200/16 D, 6 BA, 6 BB, 1 A, 533, 535

[56] References Cited

U.S. PATENT DOCUMENTS 3,794,794 2/1974 Provancher .
4,286,125 8/1981 Schaffeler et al. ..... 200/6 B
4,357,589 11/1982 Payne ..... 337/315
4,384,176 5/1983 Chestnut ..... 200/1 A

FOREIGN PATENT DOCUMENTS 0 188 215 1/1986 European Pat. Off. .

*Primary Examiner*—Corrine McDermott
*Assistant Examiner*—Michael J. Hayes
*Attorney, Agent, or Firm*—Michael J. Striker

[57] ABSTRACT

An electrical switch has a switch housing, a plurality of pin-like contact parts arranged in the switch housing substantially parallel to one another and extending in a substantially same direction, different potentials to which the contact points are connectable in groups, a contact disk provided for each potential and carrying a corresponding one of the contact parts, the contact disks having substantial identical dimensions and being stacked over one another, a plurality of intermediate layers composed of insulating material and separating the contact disks from one another, the contact parts being bent from the contact disks all in a same direction, and at a location at which one of the contact disks has one contact part, the contact part of the other contact disks are separated.

8 Claims, 4 Drawing Sheets

ELECTRICAL SWITCH, IN PARTICULAR FOR VEHICLES

BACKGROUND OF THE INVENTION

The present invention relates to an electrical switch, in particular for vehicles.

More particularly, it relates to an electrical switch which has a plurality of pin-shaped contact parts extending in a switch housing parallel to one another in the same direction and connectable in groups to different potentials.

Such switches or keys can operate as a main switch in different vehicle types and devices such as for example airplanes, motor vehicles, tractors, load lifting machines or transporting devices. It is conventional for example to form a main switch for tractors as a push button switch with a plurality of contact parts arranged in groups, so that the individual contact parts in several groups are assembled to be provided with the same potential, and the contact part of different groups distributed in a circular fashion to be connected to different potentials. The individual contact parts of each group are formed differently and have different switching functions.

The contact parts extend substantially in the axial direction of the switch and are deviated radially. They are in contact with solid contact pieces which end outside of the switch housing in plug contacts for a cable plug. The contact parts are formed so that in different switching positions the contact with respect to the fixed contact pieces are either open or closed or always connected to a potential supply. The individual contact parts of each group are bent from a ring segment extending in an angle of 90° in an axial direction, and together with it form a contact segment, whose ring segments are fixedly connected with an axially displaceable plunger, for example by riveting.

Such switches are used for different tractor types which are required for individual configurations of the individual groups of the contact part. The number and type of the contact parts assembled in the individual groups varies. This means that for each tractor version with different switching functions, a proper switch with especially formed contact groups must be produced. A producer of such switches must therefore produce a great number of differently configurated contact groups, which require the corresponding number of different punching tools and injection molds. For each new switch type, new special punching tools and injection molds are needed, which correspondingly increases the time of delivery and because of high course can be manufactured only in great numbers.

SUMMERY OF THE INVENTION

Accordingly, it is an object of the present invention to provide an electrical switch, in particular for vehicles, which avoids the disadvantages of the prior art.

More particularly, it is an object of the present invention to provide an electrical switch of the above mentioned general type, in which tool expenses for producing the contact groups are reduced.

In keeping with these objects and with others which will become apparent hereinafter, one feature of present invention resides, briefly stated, in an electrical switch having a plurality of pin-shaped contact parts which are arranged parallel to one another in a switch housing and extend in a same direction and also are connectable in groups to different potentials, wherein in accordance with present invention for each potential a contact disk is provided which carries the associated contact parts, the contact disks have substantially the same dimensions and are stacked over one another and separated from one another by intermediate layers of insulating material, the contact parts are bent from the contact disks all in the same direction, and at a point on which one of the contact disks has a contact part, the contact parts are separated from the other contact disks.

When the electrical switch is designed in accordance with the present invention, it provides for the above mentioned advantages and eliminates the disadvantages of the prior art. During the manufacture of the individual contact groups, first a universal plate is cut out which has the maximum possible number of contact parts projecting in the material plane. At this stage, all not needed contact parts are cut off by a simple tool, for example successively. Then the remaining contact parts are bent perpendicularly. The different contact groups are configurated so that at each point only one contact part is provided.

The different contact groups must be mounted not individually on the plunger, but instead they can be stacked over one another together with the intermediate layers and for example fixed by an arresting disk in the switch. This simplifies the mounting of the contact groups substantially. A further advantage of the inventive switch is that, the same tool can be utilized for all differently configurated contact groups. The new switch types can be produced in shortest time, without using new tools.

The ring-shaped disks can be formed so that the contact parts are distributed circularly, so that the contact parts can be associated to the individual contact groups in any distribution.

The separate switch pieces can have different switching functions and can be set in any distribution on the contact part formed on the contact bearing. The switching pieces are formed so that in the initial position of the plunger they are separated from the fixed contact pieces or contact with them. In the operational position of the plunger they exchange their switching functions.

In accordance with a further embodiment of the invention, the switching pieces are deviated radially and form setting contacts for the fixed contact pieces. Thereby the displacement of the contact part is unnecessary.

In accordance with still a further feature of the present invention, the contact parts with a corresponding arrangement are associated with the switching pieces of any switching functions, without any tool expenses.

The connecting pieces can be provided for the potential supply. They can produce, independently from the switching position of the plunger, a permanent connection between the plug contacts of the fixed contact pieces and the contact parts. They are compatible to the switching pieces and can be arranged therefore at any point.

Bending swings can be also provided so that the spring parts are separated from the current-conductive contact parts. Thereby the spring parts are no longer warmed up under electrical load and loose their spring action.

In accordance with still a further feature of present invention, the switching pieces or connecting pieces can be simply suspended with their holding legs in a contact part and form-lockingly locked in them.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
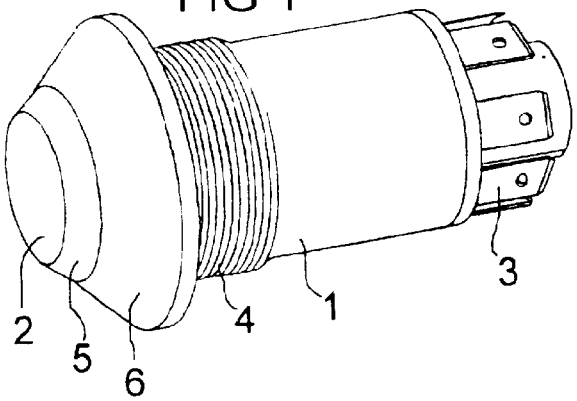
FIG. 1 is a perspective view of a main switch in accordance with the present invention, for a tractor.

FIG. 1 shows a switch for a tractor. The switch has a switch housing 1, a push button 2 and plug contacts 3 for a cable plug. The push button 2 is arranged on an operator side of the substantially cylindrical switch housing 1 so that it is coaxially displaceable. The plug contacts 3 for the cable plug are located on the rear side of the switch housing 1 which is opposite to the push button 2. The switch housing 1 is provided with a thread 4 for a nut for screwing with a not shown chassis part. An elastomeric bellows 6 is arranged between a transparent operator cup 5 of the push button 2 and a switch housing 1 for sealing the housing.

Figure 2:
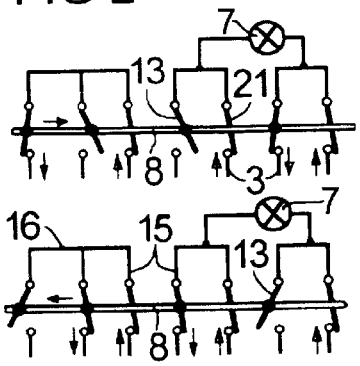
FIG. 2 is a view showing a switching diagram in a switch of FIG. 1.

FIG. 2 is composed of an upper and lower partial figures. They schematically illustrate both switching positions of the switch. Three separate current circuits are provided by the switch and can have different voltage potentials. The upwardly extending arrows identify the incoming plug contact 3 through which the voltage potentials are supplied. They are switchingly connected in the switch through contact devices with outgoing plug contacts 3 which are marked by the downwardly oriented arrows.

The contact devices have pin shaped contact parts 15 which are formed as contact bearings and are associated with the outgoing plug contact 3, and contact pieces 13 articulatly supported on them. Their contact position can be simultaneously exchanged by the adjustment of an actuating device, such as a plunger 8. A partial quantity of the switching pieces 13 is formed so that in the immovable position of the actuating device they are connected with the associated plug contact, while for the other switching pieces 13 the connection to the associated plug contacts is interrupted. The incoming plug contacts 3 are associated with connecting pieces 31 which are compatible with the switching pieces 13. They are not engaged by the actuating device and, regardless of the position of the actuating device remain in the closed switching position.

The three contact parts 15 arranged at the left are assembled to a contact group 16 which together with the associated switching pieces 13 and plug contacts 3 form a change-over switch, in which both outgoing plug contacts 3 are alternatively connected with the incoming plug contact 3. The remaining contact parts 15 are assembled into two further contact groups 16 which together with the associated switching pieces 13 and the connecting pieces 21 form two on-off switches, with one switch open and the other switch closed.

Figure 3:
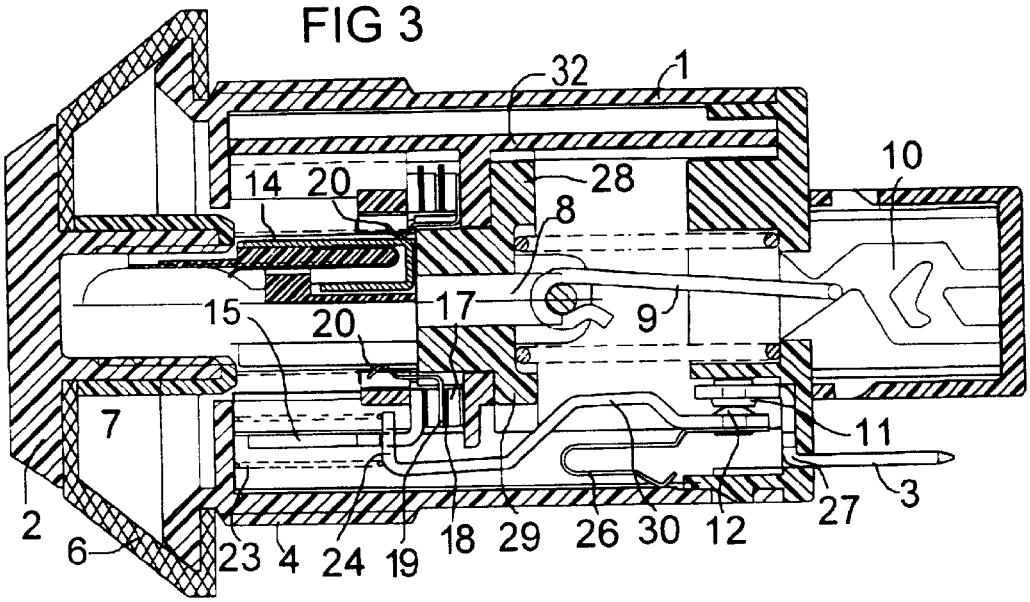
FIG. 3 is a view showing an enlarged axial section through the switch of FIG. 1 in the initial position.

In accordance with FIG. 3, an electrical incandescent lamp 7 is used as a light indicator in the interior of the push button 2. The push button 2 is connected with the plunger 8, on which an indexing pin 9 of a fixing device 10 is turnably arranged with over stroke release. The fixing device 10 serves for the purpose that the push button with the plunger in two different displacing positions can be fixed, which correspond to two different switching positions. By releasing the indexing pin 9, the switch can be converted into a simple key.

The plug contacts 3 are components of fixed contact pieces 27, which extend from the rear side of the switch housing 1 into its interior end and there form the contact points 11 for contact rivets 12 of the movably supported switching piece 13. They extend substantially in the longitudinal direction of the switch along an outer wall of the switch housing 1. Their another end is bent inwardly and forms a holding leg 24, with which it is suspended in the contact part 15 of the contact group 16 in a contacting manner as a contact support. The switching pieces 13 and the contact part 15 are supported in a cage-like separate housing part 32 for a simple mounting.

Figure 7:
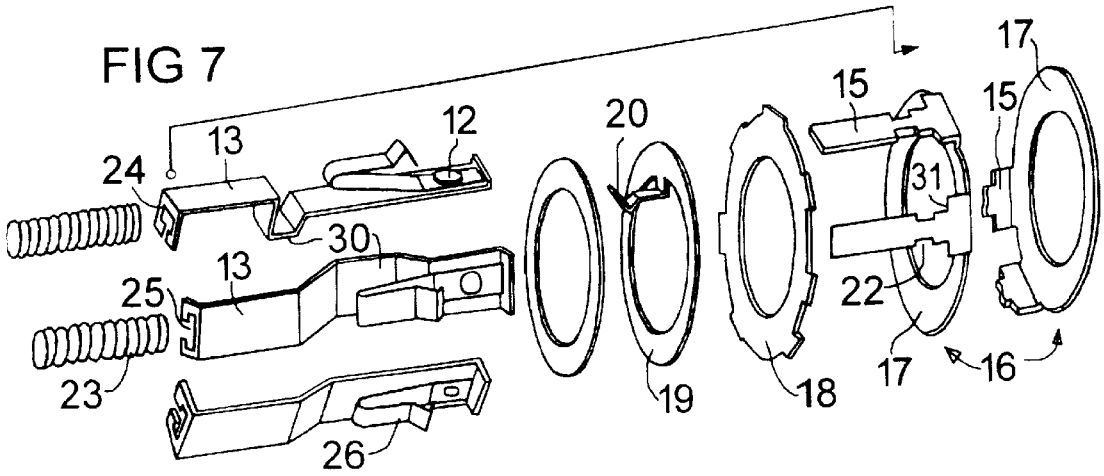
FIG. 7 is a perspective view of parts of the switch of FIG. 1.

The contact groups 16 shown in FIG. 7 are each composed of a ring-shaped contact disk 17 and at least two contact parts 15 which extend in the longitudinal direction of the switch and are bent perpendicular to the contact disk 17. Several of the contact disks 17 are stacked with insulating intermediate layers 18 in the axial direction of the switch in the switch housing 1 and fixed in this way. The contact parts 15 of the different contact groups 16 are completed to form a circular arrangement. At the locations, at which the contact parts 15 of one contact group 16 are arranged, the contact part 15 of the other contact group 16 are dispensed with. In addition, thin spring disks 19 are inserted between the contact disks 17 and the intermediate layers 18. By means of the thin spring disks, the springy contact arms 20 are in contact with the sliding contacts 14 of the incondesent lamp 7.

Figure 10:
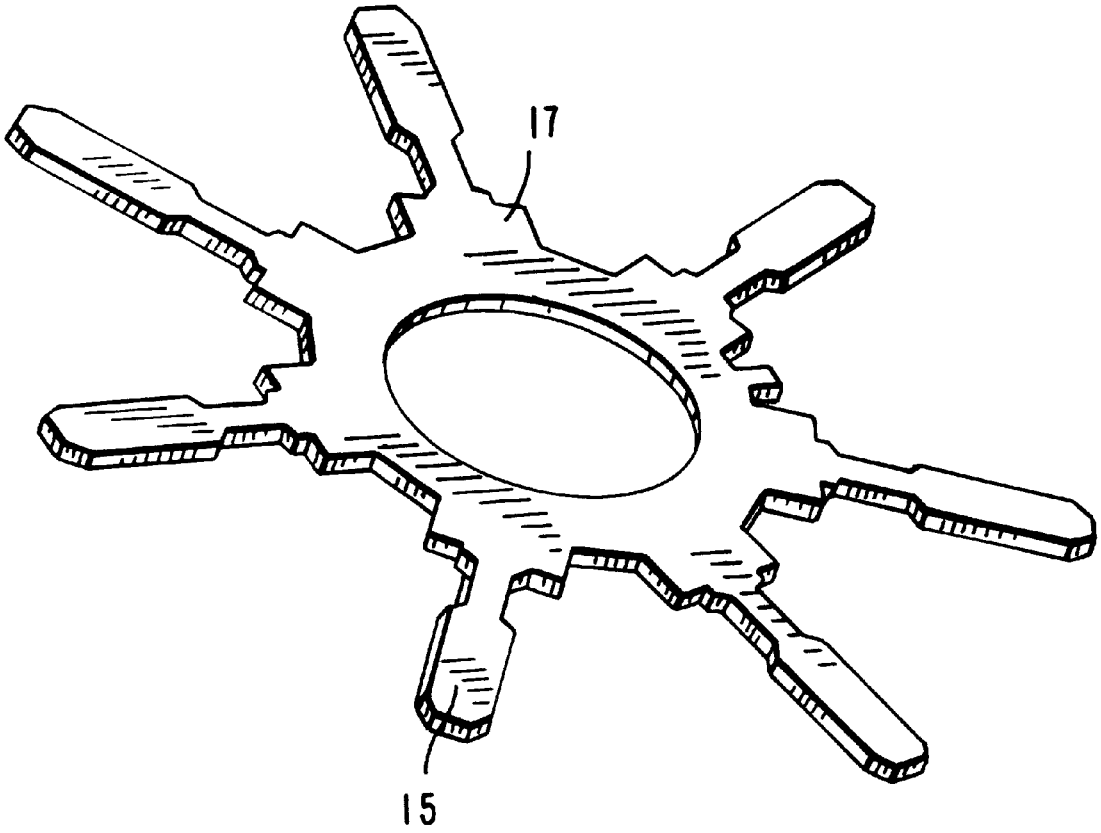
FIG. 10 is a view showing a blank of a contact disk from which some contact parts are cut off and other contact parts are bent to form contact groups.

The contact parts 15 before bending extend radially from the contact disks 17 as shown in FIG. 10. Each of this plate is provided initially with all contact parts 15 for each of the maximum possible circular positions. At this stage, by means of a simple cutting tool, each of the contact parts 15 can be for example successively cut-off, which are located at the positions, where the contact parts 15 are provided in both other contact groups. Only those contact parts remain, which are located at the positions on where the other contact groups have no contact parts 15. After bending the contact parts 15 in direction to the operator side, the contact groups in the switching housing 1 are introduced one behind the other and fixed. The contact parts 15 of all contact groups 16 form together a circular row, which corresponds to the arrangement of the plug contacts 3 on the rear side of the housing.

The contact parts 15, as shown in FIG. 7, are provided at their foot ends with an expanded projection with abutment shoulders 31 and laterally opposite recesses 22, which reduce the width of the contact part 15 at this location. The distances of the abutment shoulder 31 to the associated contact disk 17 are different and selected so that all abutment shoulders 31 are located in one plane. The remaining portion of the contact parts 15 serves for guiding of the helical pressure springs 23 which are clamped between the switch housing 1 and the holding legs 24.

The design of the switching pieces 13 and the connecting pieces 21 is illustrated in FIG. 7. At their end which faces away from the contact rivets 12, they are provided with inwardly bent holding legs 24. They have a laterally open passage 25 for the contact part 15. The width of the passage 25 corresponds to the width of the contact part 15. The width of the lateral opening of the passage 25 corresponds to the width of the contact part 15 at the recess 22.

During mounting, the holding leg is first brought to the same height with the recess of the contact part 15 and moved transversely so far against the contact part 15 that its portion with reduced width extends into the passage 24. Then the holding leg 24 is pressed through the set helical pressure spring 23 against the abutment shoulder 31. In this position, the width of the portion of the contact part 15 located in the passage 25 is greater than the width of the lateral opening, so that the switching piece 13 or the connecting piece 21 is held form-lockingly on the contact part. This fixation is however yieldable so that the switching piece 13 or the connection piece 21 is articulately supported to be radially turnable out.

A bending spring 26 is mounted on the other end of the switching piece 13 or the connecting piece 21 by the contact rivet 12. It is supported against the switch housing 1 and presses the switching piece 13 or the connecting piece 21 with the contact rivet 12 against the contact point 11 of the fixed contact piece 27.

The plunger 8 of FIG. 3 is fixedly associated with a drive part formed as a toothed rim 28 which is provided on its outer side with radially directed switching shoulders 29. The switching piece 13 has inwardly bent cam-like projections 30 which extend in the displacement path of the switching shoulders 29. When it is located at the height of the projection 30, the switching piece 13 is deviated outwardly and lifted from the contact points 11 of the fixed contact piece 27. Thereby the electrical connection is interrupted.

Figure 4:
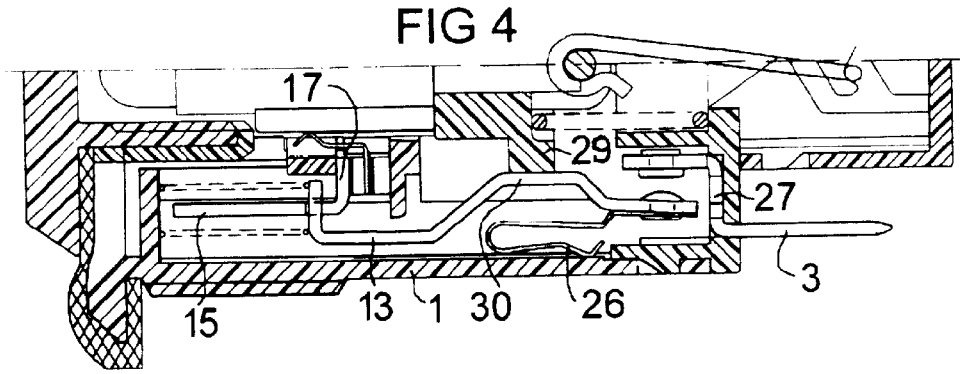
FIG. 4 is a half-section through the switch of FIG. 3 in an operational position.

In the switching piece 13 shown in FIGS. 3 and 4, the projection 30 is located at a point which is reached by the switching shoulder 29 first with the pressed-in plunger 8. This operational positions is shown in FIG. 4. The switching piece 14 is here lifted from the fixed contact piece 37. During pulling back of the plunger 8 to the outlet position shown in FIG. 3, the projection 30 is again released and the contact closed.

Figure 5:
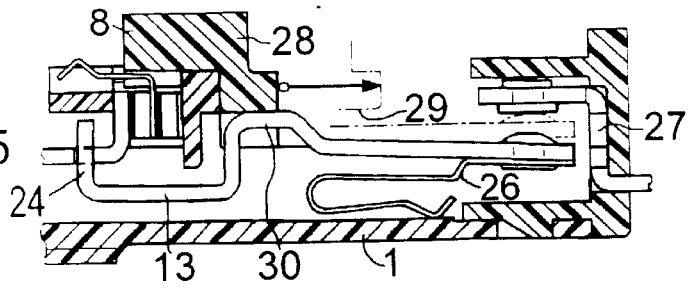
FIG. 5 is a partial section through the switch of FIG. 1 in another angular plane.

FIG. 5 shows a partial section through the switch in another angular plane. Another switching piece 13 with a reverse switching function is located in this angular plane. The projection 30 is arranged so that the switching piece 13 is lifted in the outlet position from the fixed contact piece 27 and the contact is interrupted. During displacement of the plunger 8 to the operational position of the switching shoulder 29 shown in a dash-dot line, the projection 30 is released and the contact is closed.

Figure 6:
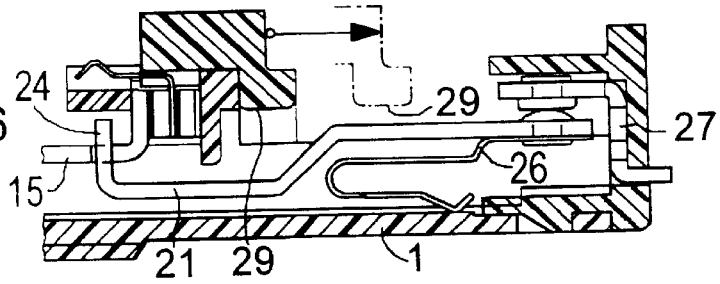
FIG. 6 is a partial section through the switch of FIG. 1 in a further angular plane.

FIG. 6 shows another partial section in which the connecting piece 21 is released. It has no projection and remains in the closed switching position in both positions of the plunger.

Figure 9:
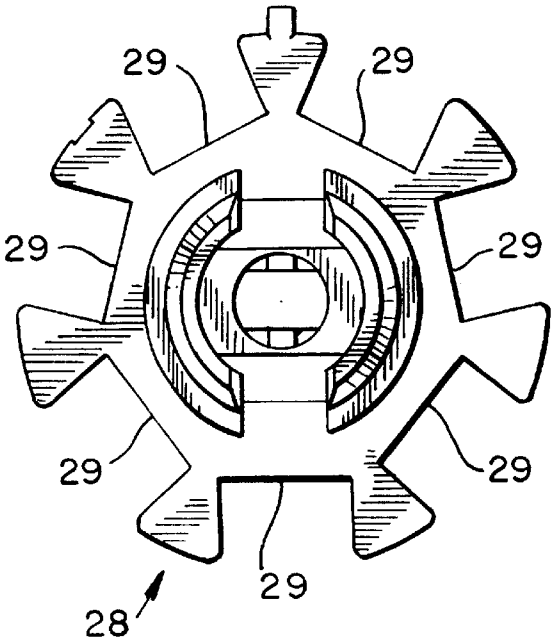
FIGS. 8 and 9 are a perspective view and an end view of the toothed rim of the switch in accordance with the present invention.
Figure 8:
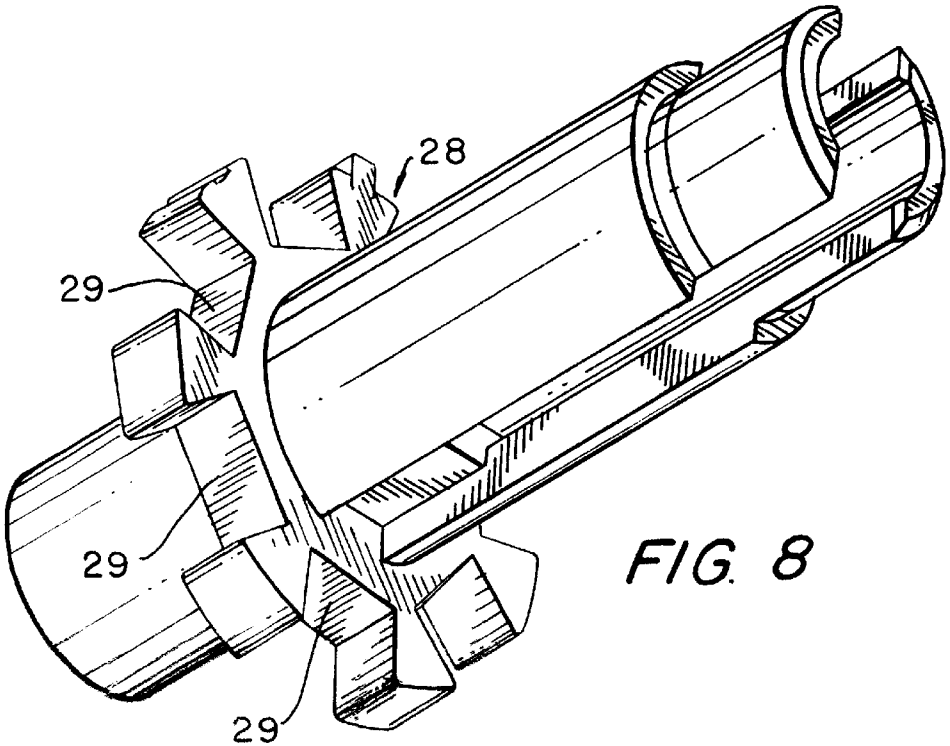

FIGS. 8 and 9 show the disc-shaped toothed rim 28 which has a plurality of teeth and seven switching shoulders 29 located between teeth. These Figures disclose all details of the construction of the toothed rim.

It will be understood that each of the elements described above, or two or more together, may also find a useful application in other types of constructions differing from the types described above.

While the invention has been illustrated and described as embodied in electrical switch, in particular for vehicles, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An electrical switch, comprising a switch housing; a plurality of pin-shaped contact parts arranged in said switch housing substantially parallel to one another and extending in a substantially same direction; means forming different potentials to which said contact parts are connected in groups, said means including a ring-shaped contact disk provided for each potential and carrying a plurality of said contact parts, said contact disks having substantial identical dimensions and being stacked over one another; a plurality of intermediate layers composed of insulating material and separating said contact disks from one another, said contact parts being bent from said contact disks all in a same direction, and at a location at which one of said contact disks has one contact part, said contact parts of said other of said contact disks are separated, said contact parts being formed as contact bearings provided with movable switching pieces which are switchably contacting with fixed contact pieces, said fixed contact pieces extending outwardly from said switch housing and have outer portions forming plug contacts for a capable plug, said switching housing being substantially cylindrical and provided with push button means; and a central axially displaceable plunger connected with radially extending drive part which is provided with radially projecting switching shoulders, and movable switching pieces extending substantially in a longitudinal direction and being spring-biased against said plunger, said movable switching pieces being provided with cam-shaped projections which are bent in direction of said plunger and actuatable by said switching shoulders of said plunger for radial deviation of said movable switching pieces, said drive part being formed as a disk-shaped toothed rim having a plurality of teeth, said switching shoulders being arranged between said teeth.

2. An electrical switch as defined in claim 1, wherein said switching pieces include switching pieces of several types provided with differently formed and arranged projections which in two displacement positions of said plunger allow different switching positions.

3. An electrical switch as defined in claim 1; and further comprising connecting pieces switchably contacting with said fixed contact pieces so as to provide a closed switching position in each displacement position of said plunger, said connecting pieces being mountable similarly to said movable switching pieces and contact with said fixed contact pieces.

4. An electrical switch, comprising a switch housing; a plurality of pin-shaped contact parts arranged in said switch housing substantially parallel to one another and extending in a substantially same direction; means forming different potentials to which said contact parts are connected in groups, said means including a ring-shaped contact disk provided for each potential and carrying a plurality of said contact parts, said contact disks having substantial identical dimensions and being stacked over one another; a plurality of intermediate layers composed of insulating material and separating said contact disks from one another, said contact parts being bent from said contact disks all in a same direction, and at a location at which one of said contact disks has one contact part, said contact parts of said other of said contact disks are separated, said contact parts being formed as contact bearings provided with movable switching pieces which are switchably contacting with fixed contact pieces, said fixed contact pieces extending outwardly from said switch housing and have outer portions forming plug contacts for a capable plug, said switching pieces having ends facing said contact parts and being provided at said ends with inwardly bent holding legs which are spring biased against abutment shoulders of said contact parts, said contact parts having a width reduced by lateral recesses provided near said abutment shoulders, said holding legs having a laterally open passage provided for said contact parts and having a width equal to a width of said contact parts said passage having a lateral opening with a width equal to a width of said contact parts at said recesses.

5. An electrical switch as defined in claim 4, wherein said contact parts of said contact disks are distributed circularly, said contact parts in unbent condition projecting from said contact disks so as to be spaced circumferentially from one another extending radially from said disc, said contact parts being bent perpendicular to a plane of said contact disks.

6. An electrical switch as defined in claim 4, wherein said switch housing is substantially cylindrical and is provided with push button means; and further comprising a central axially displaceable plunger connected with radially extending drive part which is provided with radially projecting switching shoulders, the movable switching pieces extending substantially in a longitudinal direction and being spring-biased against said plunger, said movable switching pieces being provided with cam-shaped projections which are bent in direction of said plunger and actuatable by said switching shoulders of said plunger for radial deviation of said movable switching pieces.

7. An electrical switch as defined in claim 4, wherein said switch housing is a substantially cylindrical switch housing having push button means; and further comprising a centrally axially displaceable plunger connected fixedly with a radially projecting drive part; and connecting pieces extending substantially in a longitudinal direction and contacting with fixed contact pieces so as to provide a closed switching position.

8. An electrical switch as defined in claim 7; and further comprising movable switching pieces, and separate bending springs which press said switching pieces and connecting pieces separately against contact points of said fixed contact pieces.

* * * * *